United States Patent [19]

Stiles

[11] 4,033,279

[45] July 5, 1977

[54] FAIRED CABLE FOR ANCHORING OFFSHORE STRUCTURES

[75] Inventor: Kenneth M. Stiles, San Dimas, Calif.

[73] Assignee: Sea-Log Corporation, Pasadena, Calif.

[22] Filed: Feb. 27, 1976

[21] Appl. No.: 662,218

[52] U.S. Cl. ..... 114/243
[51] Int. Cl.[2] ..... B63B 21/00
[58] Field of Search ..... 114/243

[56] References Cited

UNITED STATES PATENTS

| | | | |
|---|---|---|---|
| 2,401,783 | 6/1946 | Wilcoxon | 114/235 F |
| 3,241,513 | 3/1966 | Rather et al. | 114/235 F |
| 3,712,261 | 1/1973 | McLelland et al. | 114/235 F |
| 3,859,949 | 1/1975 | Toussaint et al. | 114/235 F |

FOREIGN PATENTS OR APPLICATIONS

| | | | |
|---|---|---|---|
| 345,020 | 7/1920 | Germany | 114/235 F |
| 790,001 | 1/1958 | United Kingdom | 114/235 F |

*Primary Examiner*—Trygve M. Blix
*Assistant Examiner*—Stuart M. Goldstein
*Attorney, Agent, or Firm*—Christie, Parker & Hale

[57] ABSTRACT

There is provided a reusable flexible fairing for securing to anchoring cables to reduce cable drag which consists of two wedge shaped interlocking body members interconnected by a flexible web providing a contoured inner surface which in combination with contoured end walls of the body members embrace the cable to be faired and provide a streamline cross-sectional profile for minimizing drag. There is also provided a system for adding and removing the fairing from a cable.

5 Claims, 5 Drawing Figures

FAIRED CABLE FOR ANCHORING OFFSHORE STRUCTURES

BACKGROUND OF THE INVENTION

The cables used to moor semi-permanent offshore platforms, such as drilling platforms for use either to open water or ice bound areas can be of material length. For certain location, the length of the cable can be such that cable drag approaches that of the moored structure itself. Cable drag is particularly aggravated where sub-surface currents are great.

To minimize the cable drag, it has been proposed to fair the cable. Heretofore, the procedure used has been to add finite lengths of a disposable fairing to the cable as it is played out. The fairing lengths are bound together by bolts, rivets or the like, and only used once. Because of the bulk they add to the cable, it has been impossible to retrieve both the cable and fairing intact because of the configuration of the fairing and the size of the drum which would be essential to winding of the faired cable. For instance, problems of jamming occur if more than a layer of cable and fairing are rolled onto the drum. As a consequence, the fairing which was added piecemeal when the cable was played out is removed and discarded when the cable is drawn in. This is costly and requires a continuous stock pile of the dispensible fairings.

SUMMARY OF THE INVENTION

According to the present invention, there is provided an improved fairing for cables which can be added to the cable on a continuous basis when the cable is played out and removed from the cable when it is drawn in. There is also provided a system for fairing and unfairing the cable.

The fairing consists of a continuous length of an extruded or molded fairing body split about its symmetrical axis into two halves interconnected by a flexible web and provided with interlocking means to join the symmetrical halves about the cable. To achieve this, at least the mass of the fairing body is elastomeric. One-half of the body of the open fairing is provided with recesses to couple and interlock with projections on the body of the other half when the two are urged together.

In particular, each body member is elastomeric and substantially wedge shaped and consists of an essentially planar inner surface and a tapered outer surface connected to one edge of the planar inner surface and extending outwardly from the planar inner surface to the web, and a contoured end wall connecting the opposed edge of the planar inner surface to a contoured surface provided by the web. The contour of each end wall is such that they will cooperate with the contoured surface provided by the web and mate with the cable to be faired. One of the body members has at least one shaped projection which extends outward from the planar surface thereof. The projection progressively increases in width from the point of connection to the planar surface to a point along the elevation of the projection. From that point the width progressively decreases until the apex of the projection is reached. The other elastomeric wedge shaped body member has a receptable to receive an interlock with the projection. The two elastomeric wedge shaped bodies are connected by a flexible web having a contoured inner surface adapted to cooperate with the walls of the two body members such that when the open fairing is folded and the projection interlocked with receptacle, there is formed an opening substantially conforming to the shape of the cable to be faired.

The system for continuously fairing cables consists of a drum for dispensing the cable to be faired and a fairing drum for dispensing the fairing when opened about its axis of symmetry. The two cooperate with a die which receives the dispensed cable and open fairing and which includes means to fold the fairing about the cable and interlock with two body members of the fairing. When the cable is drawn in, the die serves to split the fairing about its symmetrical axis to enable it to be drawn onto a reel separate from the cable reel.

THE DRAWINGS

FIG. 5 illustrates one system for combining the cable and fairing as the two are played out and for separating the fairing from the cable when the cable is drawn in.

FIG. 6 illustrates a compound die for forming the fairing about the cable and separating the fairing from the cable when the cable is drawn in.

DETAILED DESCRIPTION

According to the present invention, there is provided a system for continuously fairing cables as they are played out and for removing and storing the fairing when the cable is drawn in.

Figure 1:
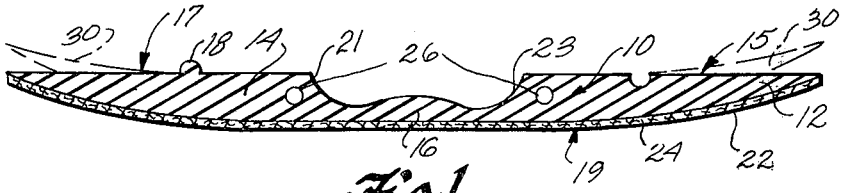
FIGS. 1 and 2 illustrate cross sections of extruded fairing for forming about a cable.
Figure 2:
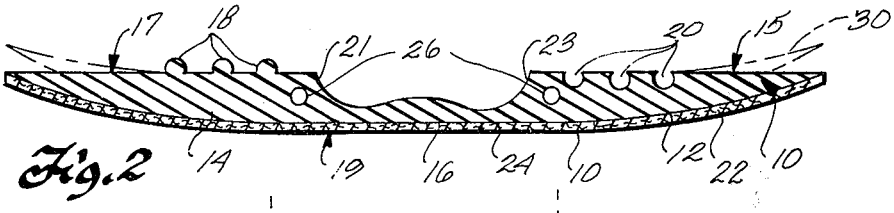

An essential element of the system is the fairing itself. With reference to FIGS. 1 and 2, the fairing 10 basically consists of two body halves 12 and 14 joined by a flexible web 16. Preferably, the body halves 12 and 14 and the interconnecting web 16 are of a common material. The material typically is sufficiently flexible to enable winding onto a reel and for the male projections 18 on body half 14 to interconnect and lock to female receptacles 20 on body half 12. One body may have both projections and receptacles for mating with projections and receptacles on the other body.

More particularly, the fairing 10 consists of a pair of elastomeric essentially wedge shaped body members 12 and 14 each having essentially planar linear inner surfaces 15 and 17 and a tapered outer surface 19 connected to the outer edges of the planar inner surfaces 15 and 17. Contoured end walls 21 and 23 connect the opposed edges of the planar inner surfaces to the contoured web 16 extending from the outer surface 19. The contours of the end walls 21 and 23 are such that it will mate with the cable to be faired. On body member 14 at least one shape projection(s) 18 extends outward from the surface thereof. The projection progressively increases in width from the point of connection to the planar surface to a point along the elevation of the projection. From that point, the width progressively decreases until the apex of the projection is reached. The other elastomeric wedge shaped body member 12 has a mating receptacle(s) 20 to receive an interlock with the projection. The two elastomeric wedge shaped bodies are connected by a flexible web 16 having a contoured inner surface adapted to cooperate with the walls of the two body members such that when the open fairing is folded and the projection interlocked with receptacle, there is formed an opening conforming to the shape of the cable to be faired.

Elastomeric materials are typically employed for the fabrication of the fairing body and include natual and synthetic rubbers, olefin polymers, flexible urethane polymers, vinyl polymers and the like.

Where desired, the outer exposed face 22 of the fairing can be reinforced with a webbing 24 provided along all or a portion of the exposed fairing body. The webbing, if provided, reinforces the interconnecting web 16 and is typically of a flexible high strength woven or nonwoven fabric formed of glass fibers, nylon, Kevlar or the like. The nature of the reinforcing fabric for web 24 is such that it should be wetted by the material forming the body of the fairing to form both a cohesive and adhesive bond thereto during the molding for extrusion operations which leads to the formation of the fairing. In the molding or extrusion of the fairing, the materials should penetrate through the fabric to make the fabric part of the fairing itself. The elastomeric material which penetrates the cloth forms a smooth skin over cloth to reduce surface friction.

Web 16 is contoured such that when the fairing is folded and coupled it will have an opening conforming to that of the cable it surrounds. As desired, communication cables, optical fibers or stiffeners 26 can be formed in the body of the fairing.

Figures 3, 4:
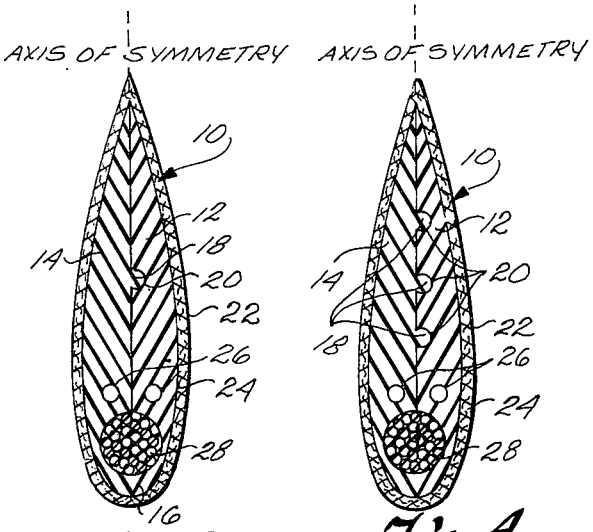
FIGS. 3 and 4 illustrate faired cable formed from the extruded fairings of FIGS. 1 and 2.

With reference to FIGS. 3 and 4, the completed faired cables are shown. The cable tensile member 28 occupies the frontal portion of the faired cable and is surrounded by the web portion 16 of the fairing. Bodies 12 and 14 are joined and interlocked by the joining of projections 18 with the conforming ground receptacles 20.

Cable 28 may be of any materials sufficiently flexible to be rolled, and may be, for instance, a steel cable, a nylon robe, a resin reinforced fiber cable or the like.

If desired, a biased interlocking fit can be achieved and the ends by extruding or molding the fairing with its end 30 upturned. The upturned ends compressively bias against each other when the faired cable is formed. The projection 18 and receptacles 20 maY be individually and regularly spaced along the length of the fairing or continuous along the length of the fairing. The latter configuration is most compatible with extrusion operations.

Figure 5:
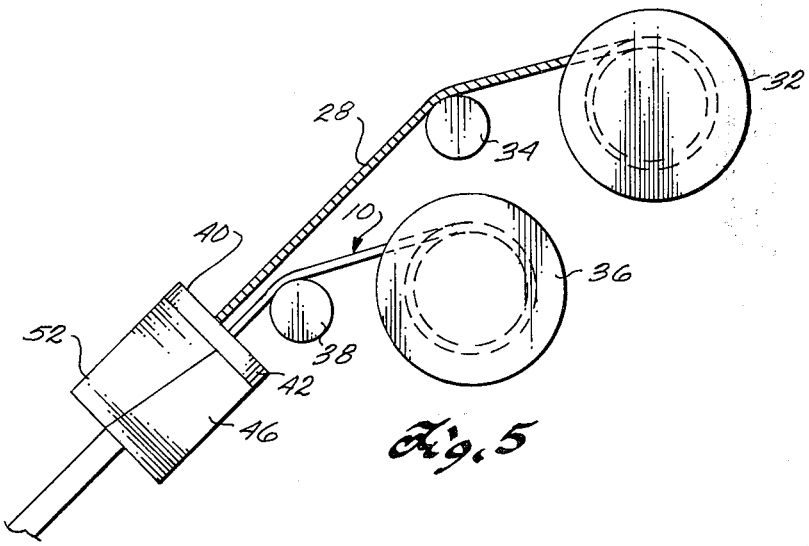

FIG. 5 illustrates one system for combining the fairing with the cable. With reference thereto, the cable 28 is contained on cable reel 32 which plays out the cable 26 over roller 34. Simultaneously, the fairing 10 contained on fairing reel 36 and opened about its axis of symmetry as depicted in FIG. 1 and FIG. 2 is played out over roller 38. The two are combined in compound die 40 which serves to fold the fairing about the cable and to interlock the two halves of the fairing to enable continuous feed out of the cable and the enclosing interlocked fairing.

When it is desired to draw the cable the same coupling die serves to peel the fairing from the cable in order that the two may be separately wound on their respective roles.

Figure 6:
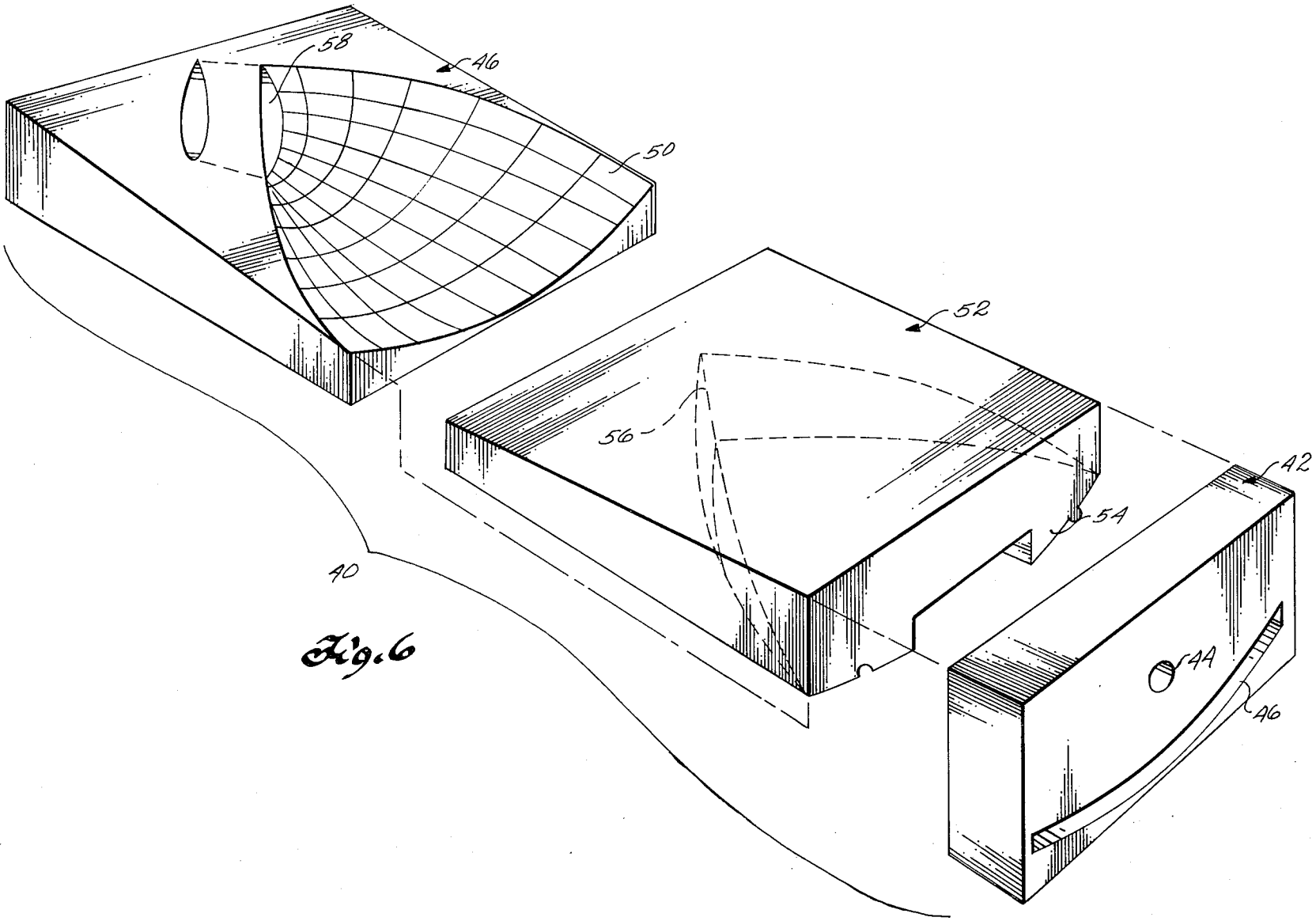

FIG. 6 illustrates typical elements of a compound forming die 40. Block 42 contains opening 44 shaped to receive and guide the cable into the die. Opening 46 is shaped to receive the fairing and begin to form it to the provided contour 50 of block 46 about the cable as it passes into the die.

Die member 52 contains a protrusion 54 which mates the general contour of the advanced fairing and is provided with a leading knife edge 56 to part the fairing when the cable is drawn in.

Block member 46 of die 40 provides the contour 50 to fold the fairing about the cable and tapered opening 58 which interlocks the two halves of the fairing.

In operation, the internal contour 50 of die section 46 in cooperation with the conforming opening 58 continuously wraps the fairing about the cable and causes the projections 18 to interlock with openings 20. In this operation, the contoured projection 54 of die section 52 is relatively non-functional.

When the cable is drawn in knife edge 56 of die section 52 it serves to open the fairing while the contoured surface 54 spreads the fairing out to conform to the shape of contour 50 in order that it will pass through opening 46 of die section 42 for inevitable winding on reel 36.

The principle utility of the faired cable of this invention is to anchor offshore vessels on a semipermanent basis. They may be used for instance to anchor drilling platforms which must be repositioned as bore hole locations are varied. A most desired application is where the platform is moved in ice bound areas where despite the provisions of ice comminuting operations to char advancing ice, considerable ice loads are imposed on the structure. Cable anchors help to overcome these loads. Because current flows are considerable and water depth substantial, it is important to minimize cable drag. The faired cables of this invention enable this result and are most economical since the fairing can be repeatedly used.

What is claimed is:

1. A fairing assembly for cables which comprises:

a. a pair of elongate elastomeric, wedge shaped body members each having an essentially planar inner surface, a tapered outer surface connected to one edge of each planar inner surface and extending outwardly therefrom to an elongate flexible web interconnecting said pair of body members at said tapered outer surfaces, and a contoured end wall connected to the edge opposed to said one edge of each planar inner surface and extending to a contoured inner surface provided by the flexible web, one of said body members having at least one shaped projection extending outward from the planar inner surface thereof, the projection progressively increasing in width from the point of connection to the planar surface to a point along the elevation of the projection from the planar surface, then progressively decreasing in width to the apex thereof, the other of said bodies having a receptacle adapted to receive said projection in interlocking relation, the contoured end walls cooperating with the contoured inner surface provided by the web to form an opening having the shape of the cable to be faired when the shaped projection of one of said body members is interlocked with the receptacle of the other body member and each one edge of each planar inner surface, at the edge of connection to the tapered outer surface, being upwardly turned to form a biased compressive seal when said body members are connected in interlocking relation.

2. A fairing assembly as claimed in claim 1 in which at least the web is fabric reinforced.

3. A fairing assembly as claimed in claim 2 in which the fabric reinforcing extends along at least a portion of the tapered outer surface of each wedge shaped body member.

4. A fairing assembly as claimd in claim 1 in which the projection from one planar surface and receptacle in the other planar surface of the wedge shaped body members are coextensive with the length of the fairing.

5. A system for continuously fairing cables which comprises:

a. a means for playing a cable to be faired;

b. means for dispensing a fairing body opened about the axis of symmetry thereof, the fairing body being comprised of two interlockable wedge shaped elastomeric body members connected by a flexible web, the said interlockable wedge shaped body members and web laying in an essentially common plane when dispensed; and c. die means adapted to receive the played out cable and the dispensed opened fairing body, said die means including means to fold the web and wedge shaped body members of the fairing body around the cable and interlock said wedge shaped body members; said die means including knife edge means to open the interlocked fairing body when said cable and fairing body are drawn through said die in a reverse direction.

* * * * *

UNITED STATES PATENT AND TRADEMARK OFFICE

CERTIFICATE OF CORRECTION

PATENT NO. : 4,033,279

DATED : July 5, 1977

INVENTOR(S) : Kenneth M. Stiles

It is certified that error appears in the above-identified patent and that said Letters Patent are hereby corrected as shown below:

Column 3, line 2, "natual" should read -- natural --; Column 3, line 36, "robe" should read -- rope --; Column 3, line 41, "ma Y" should read -- may --; Column 3, line 60, "roles" should read -- rolls --.

Column 4, line 31, "most" should read -- more --.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*